US011759719B2

(12) United States Patent
Desflammes et al.

(10) Patent No.: US 11,759,719 B2
(45) Date of Patent: Sep. 19, 2023

(54) MOVABLE SUB-ASSEMBLY FOR ACCOMMODATING AND CONVEYING AT LEAST ONE PASSENGER AND ASSOCIATED ATTRACTION INSTALLATION

(71) Applicant: SIGMA COMPOSITE, Les Avenieres-veyrins-Thuellin (FR)

(72) Inventors: Philippe Desflammes, Gruffy (FR); Thierry Vittoz, Chimilin (FR)

(73) Assignee: SIGMA COMPOSITE, Les Avenieres (FR)

( * ) Notice: Subject to any disclaimer, the term of this patent is extended or adjusted under 35 U.S.C. 154(b) by 310 days.

(21) Appl. No.: 17/291,438

(22) PCT Filed: Nov. 5, 2019

(86) PCT No.: PCT/EP2019/080182
§ 371 (c)(1),
(2) Date: Aug. 16, 2021

(87) PCT Pub. No.: WO2020/094612
PCT Pub. Date: May 14, 2020

(65) Prior Publication Data

US 2022/0001287 A1 Jan. 6, 2022

(30) Foreign Application Priority Data

Nov. 5, 2018 (FR) ..... 1860165

(51) Int. Cl.
*A63G 27/02* (2006.01)
*A63G 29/02* (2006.01)

(52) U.S. Cl.
CPC ..... *A63G 27/02* (2013.01); *A63G 29/02* (2013.01)

(58) Field of Classification Search
CPC ..... A63G 27/00; A63G 27/02; A63G 29/00; A63G 29/02
(Continued)

(56) References Cited

U.S. PATENT DOCUMENTS

2005/0113178 A1* 5/2005 Bussink ..... A63G 27/02 472/44
2012/0260816 A1* 10/2012 Vittoz ..... A63G 27/00 104/76
(Continued)

FOREIGN PATENT DOCUMENTS

CN 207627905 7/2018
JP 2003199978 7/2003
(Continued)

OTHER PUBLICATIONS

PCT/EP2019/080182, Jan. 22, 2020, International Search Report and Written Opinion.

*Primary Examiner* — Kien T Nguyen
(74) *Attorney, Agent, or Firm* — RAY QUINNEY & NEBEKER P.C.; Paul N. Taylor

(57) ABSTRACT

A movable sub-assembly (30) for accommodating and conveying at least one passenger, comprising a support (20), a cabin (22) and a guide (32) for rotationally guiding the cabin (22) relative to the support (20) about a reference axis (200) common to the support (20) and to the cabin (22), the reference axis (200) being horizontal when the movable sub-assembly (30) is in an operational state. The movable sub-assembly (30) is equipped with a stabilization system (36) comprising at least one toothed ring (38) rigidly connected to the support (20) and centered on the reference axis (200), at least one first gear (40) supported by the cabin (22) so as to mesh with the toothed ring (38), and drive means (42) capable of driving the first gear (40). The first gear (40)
(Continued)

is supported by the cabin (22) so as to mesh with a zone of the toothed ring (38) that is located above the first gear (40).

15 Claims, 5 Drawing Sheets

(58) Field of Classification Search
USPC ..... 472/29, 30, 44, 45
See application file for complete search history.

(56) References Cited

U.S. PATENT DOCUMENTS

| | | | | |
|---|---|---|---|---|
| 2013/0023350 | A1* | 1/2013 | Morand | A63G 29/02 472/45 |
| 2016/0008724 | A1* | 1/2016 | Mayer | A63G 27/02 472/45 |
| 2018/0311586 | A1* | 11/2018 | Mayer | A63G 27/00 |

FOREIGN PATENT DOCUMENTS

| | | |
|---|---|---|
| JP | 2005046239 | 2/2005 |
| JP | 2010005316 | 1/2010 |

* cited by examiner

MOVABLE SUB-ASSEMBLY FOR ACCOMMODATING AND CONVEYING AT LEAST ONE PASSENGER AND ASSOCIATED ATTRACTION INSTALLATION

TECHNICAL FIELD OF THE INVENTION

The invention relates to the transport of a passenger in a cabin following a trajectory of which the angle with respect to the horizontal is not constant.

PRIOR ART

DE476892 describes an attraction installation comprising a stationary structure, a movable structure which rotates relative to the stationary structure about an axis of rotation, and spherical cabins which are supported by the movable structure so as to rotate relative to the movable structure about an axis parallel to the axis of rotation. The rotational guidance of each cabin relative to the movable structure is brought about by means of a bearing having a large diameter which surrounds the cabin, the inner bearing race of which bearing is fixed to the movable structure and the outer bearing race of which is rigidly connected to the cabin. The cabins are ballasted in such a way that the floors thereof remain more or less horizontal when the movable structure rotates about the axis of rotation at a low speed. A slight swinging of the cabins about their axis is permissible, and even desirable for the entertainment of the passengers.

To stabilize the cabins and control their rotation about their axes, JP2010005316 suggests fixing a toothed ring to the stationary inner bearing race, the teeth of which ring are oriented radially toward the inside, and installing under the floor of each cabin a motorized drive device having two gears which mesh with the toothed ring.

However, this arrangement poses a risk of malfunction if a rigid foreign object which has dimensions compatible with the size of the teeth and is trapped by the lubricant covering the toothed ring becomes lodged between the teeth and jams the stabilization mechanism.

DISCLOSURE OF THE INVENTION

The invention aims to remedy the drawbacks of the prior art and to propose a stabilization mechanism which does not pose the aforementioned risk of failure.

In order to achieve this, a first aspect of the invention proposes a movable sub-assembly for accommodating and conveying at least one passenger, comprising a support, a cabin, and a guide for rotationally guiding the cabin relative to the support about a reference axis common to the support and to the cabin, the reference axis being horizontal when the movable sub-assembly is in an operational state. The movable sub-assembly is equipped with a stabilization system comprising at least one toothed ring rigidly connected to the support and centered on the reference axis, at least one first gear supported by the cabin so as to mesh with the toothed ring, and drive means capable of driving the first gear, characterized in that the first gear is supported by the cabin so as to mesh with a zone of the toothed ring that is located above the first gear.

Positioning the first gear below the zone of the toothing with which it meshes encourages any foreign elements which may have settled on the toothing to fall under the action of gravity before they reach the zone of meshing with the first gear.

The first gear is preferably guided relative to the cabin so as to rotate about a first drive axis parallel to the reference axis. For this falling effect to be effective, it is preferable for the first gear to mesh with a zone of the toothed ring that is at a sufficient distance from the horizontal plane containing the reference axis. The first drive axis is preferably positioned, with respect to an axial reference plane, in an angular sector less than or equal to 60° around the reference axis and on a first side of the axial reference plane, the axial reference plane being vertical and containing the axis of rotation when the movable sub-assembly is in the operational state.

According to one embodiment, the first drive axis is positioned in the axial reference plane. This arrangement will be particularly favorable if the direction of rotation of the cabin relative to the support is not always the same.

According to another embodiment, the first drive axis is positioned at a distance from the axial reference plane on a first side of the axial reference plane. This arrangement will be particularly favorable if the direction of rotation of the cabin relative to the support is always the same, or if there is a privileged direction of rotation. More specifically, the first gear can be positioned on the side of the axial reference plane located downstream of the axial reference plane in the direction of rotation of the toothed wheel, or in other words on the side of the axial reference plane from which the zone of the toothing with which the first gear meshes is spaced apart. In this way, it is ensured that the zone of the toothing with which the first gear meshes at a given moment has previously passed through the axial reference plane with its teeth oriented downward, which is the most favorable position to ensure that any foreign object that could have settled on the toothing falls away.

The stabilization system can also comprise a coupling device for coupling the gear to the toothed ring and uncoupling it from the toothed ring, a clutch for coupling the gear to the motor assembly and uncoupling it from the motor assembly, and/or a brake for braking the gear.

According to a variant of this embodiment, the stabilization system comprises at least one second gear which is supported by the cabin so as to mesh with the toothed ring and which is driven by the drive means, the second gear being capable of meshing with a second zone of the toothed ring that is located above the second gear, and the second gear being guided relative to the cabin so as to rotate about a second drive axis which is parallel to the reference axis and which is positioned, with respect to the axial reference plane, in an angular sector less than or equal to 60° around the reference axis at a distance from the axial reference plane on a second side of the axial reference plane that is opposite the first side. A symmetrical system is thus provided. The motor unit for driving the first gear and the second gear can comprise two independent motors or a single motor. The stabilization system preferably comprises a coupling device capable of alternately coupling the first gear or the second gear to the toothed ring. The coupling device can therefore be controlled on the basis of the direction of rotation of the toothed ring such that only the gear located downstream of the axial reference plane in the direction of rotation of the toothed wheel meshes with the toothed wheel, the other gear being uncoupled.

According to one embodiment, the guide comprises at least one bearing comprising a first bearing ring rigidly connected to the support, a second bearing ring rigidly connected to the cabin, and bearing bodies capable of rolling on bearing races formed on the first bearing ring and the second bearing ring, the second bearing ring surrounding the inner accommodating volume of the cabin.

According to one embodiment, the cabin has an inner volume for accommodating at least one passenger, the toothed ring surrounding the inner accommodating volume when viewed in a section in a plane perpendicular to the reference axis.

If necessary, a device for cleaning the toothed ring is positioned in an angular sector of the toothed ring located between the zone of the toothing with which the first gear meshes and a plane which contains the reference axis and is horizontal when the movable sub-assembly is in the operational state. A device of this kind, preferably located immediately in front of the gear in the direction of rotation of the toothed ring, is arranged under the zone of the toothing with which it interacts, so as to exert some of the gravity which tends to remove foreign objects.

According to one embodiment, a device for detecting obstructions to meshing is positioned in an angular sector of the toothed ring located between the zone of the toothing with which the first gear meshes and a plane which contains the reference axis and is horizontal when the movable sub-assembly is in the operational state. If the gravity or, if present, the cleaning device prove insufficient for releasing a foreign object trapped in the lubricant on the toothed surface of the ring, the device for detecting obstructions allows the movable sub-assembly to be stopped before the foreign object that constitutes the obstruction makes effective contact with the gear.

The cabin preferably has a center of gravity located in an axial reference plane of the cabin that is perpendicular to the floor and contains the reference axis. This is desirable in order to limit the energy required to maintain the horizontality of the floor with the stabilization system.

The center of gravity of the cabin is preferably located below the reference axis. A downgraded operating mode can therefore be provided in which the stabilization system is uncoupled or allows the first gear to rotate freely, an approximate horizontality being maintained as a result of gravity.

According to a preferred embodiment, the toothed ring has a toothing that faces the reference axis. The first gear is preferably positioned above an inner ceiling of the cabin. There is thus a compartment below the floor in which it is possible, if necessary, to place a stabilization ballast. According to one particularly advantageous embodiment, a cooling, heating, or air conditioning unit of the cabin is positioned below an inner floor of the cabin. By virtue of its mass, a unit of this kind constitutes a stabilization ballast.

According to an alternative embodiment, the toothed ring has a toothing that faces radially outward, the first gear being positioned below a floor of the cabin.

According to another aspect of the invention, said toothed ring is connected to an attraction installation comprising at least one stationary structure and at least one movable sub-assembly according to the first aspect of the invention which is guided relative to the stationary structure in such a way that the support follows a trajectory that forms a loop in a vertical plane of a fixed frame of reference, and which, with respect to a fixed axis of rotation that is perpendicular to the vertical plane and parallel to the reference axis, makes a rotation of 360° by completing a lap of the loop-shaped trajectory.

According to one embodiment, the axis of rotation is fixed and preferably defined by an assembly of one or more guide bearings which are rigidly connected to the stationary structure. The rotation is preferably more than one lap, in particular for a Ferris wheel-type attraction installation. The support can therefore be a car intended to be fixed to a rim of the Ferris wheel, or a part of the rim itself, rotating about the axis of rotation.

BRIEF DESCRIPTION OF THE DRAWINGS

Other features and advantages of the invention can be found in the following description, with reference to the appended drawings, in which.

For greater clarity, identical or similar elements are identified by identical reference signs in all of the drawings.

DETAILED DESCRIPTION OF EMBODIMENTS

Figure 1:
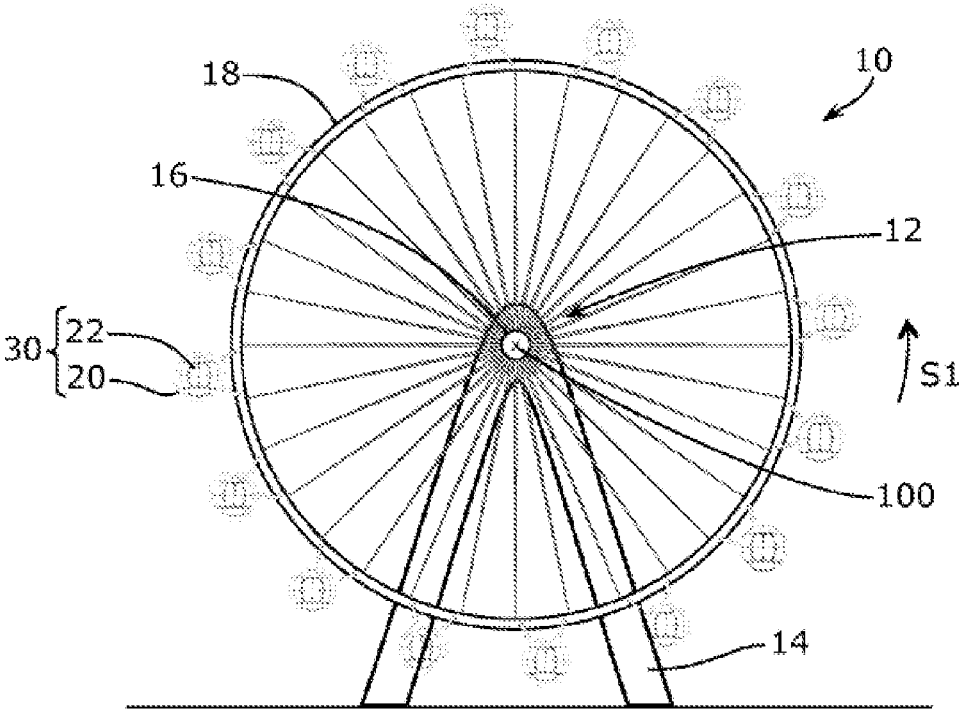
FIG. 1 is a partial view of an attraction installation according to the invention.

FIG. 1 shows a Ferris wheel installation 10 on the horizontal axis of rotation 100 comprising a stationary structure 12 mounted on the ground by means of one or more feet 14, said stationary structure 12 forming a guide bearing 16 of a wheel rim 18 rotating about an axis of rotation 100 which is fixed relative to the ground 14. The rim is provided on its periphery with supports 20 for cabins 22. The axis of rotation 100 preferably constitutes an axis of rotational symmetry of the order N for the rim, N being the number of supports 20 and cabins 22.

Figure 2:
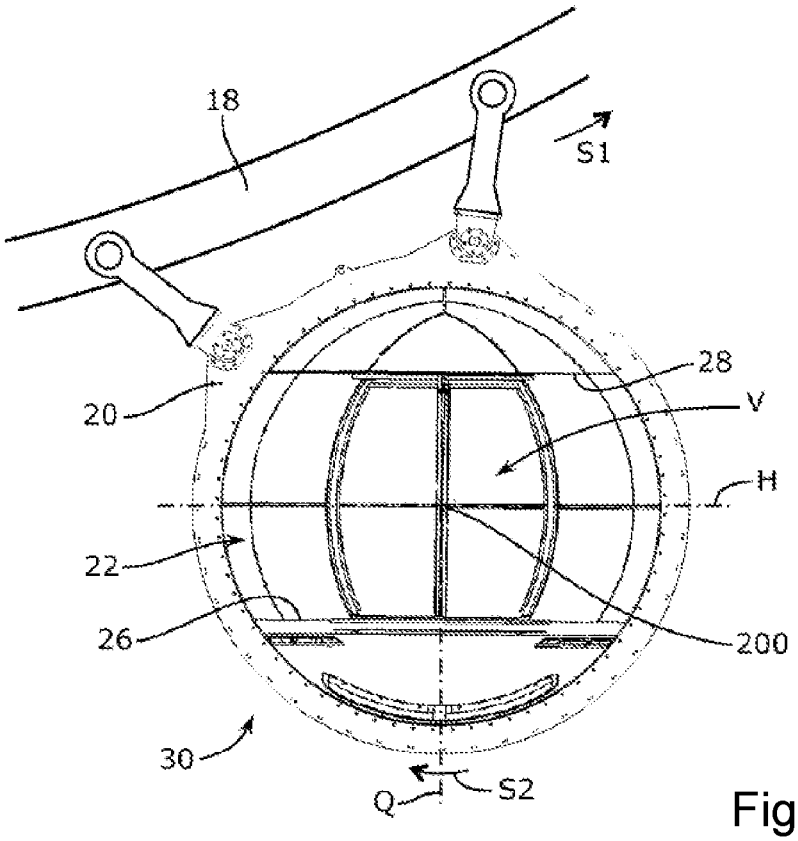
FIG. 2 is a frontal view of a movable sub-assembly of the installation from FIG. 1.
Figure 3:
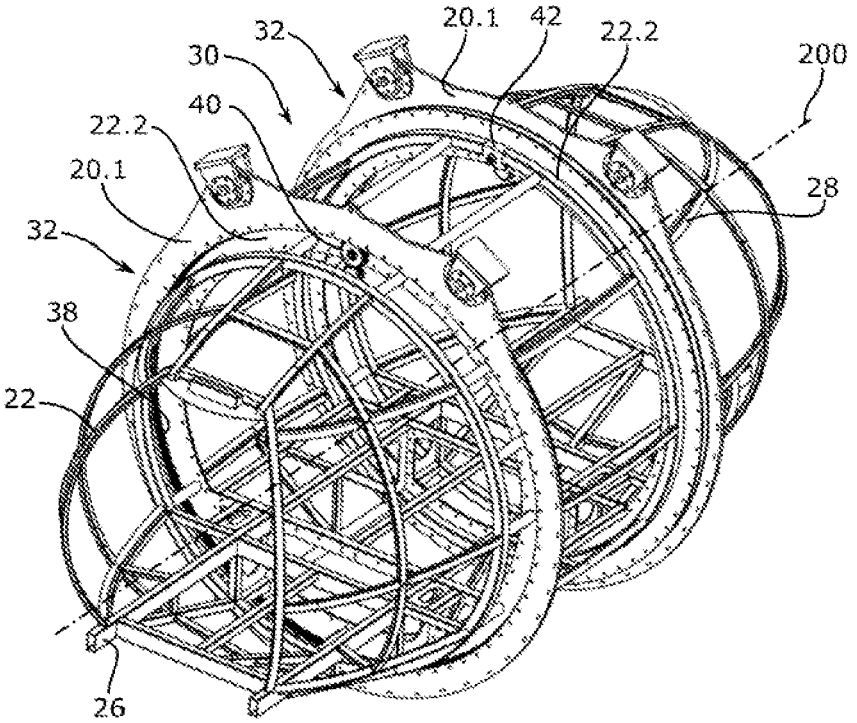
FIG. 3 is an isometric view of a structure of the movable sub-assembly from FIG. 2, in particular illustrating a stabilization system according to a first embodiment of the invention.
Figure 4:
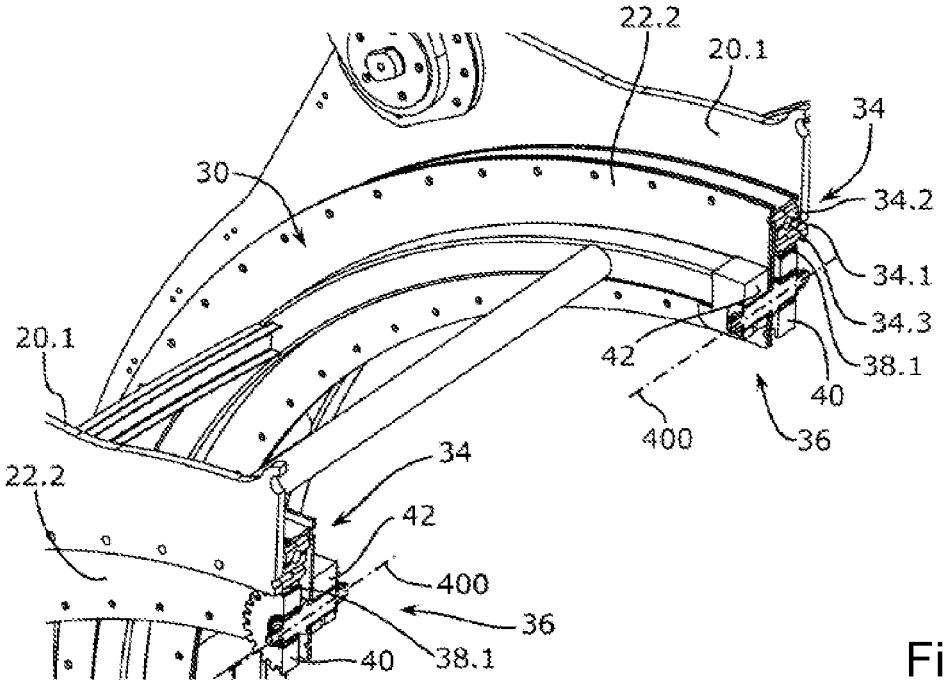
FIG. 4 is an isometric view of an axial section of the structure of the movable sub-assembly from FIG. 2.

As shown in FIG. 2, each cabin 22 has an inner volume V for accommodating and conveying one or more passengers, which is delimited between a cabin floor 26 and a cabin ceiling 28. The support 20 and the associated cabin 22 thus form a movable sub-assembly 30 for accommodating and conveying one or more passengers. This movable sub-assembly 30, the structure of which is shown in detail in FIGS. 3 to 6, also comprises a guide 32 for rotationally guiding the cabin 22 relative to the support 20 about a reference axis 200 common to the support 20 and to the cabin 22, the reference axis being horizontal and parallel to the axis of rotation 100.

The guide 32 here consists of two coaxial bearings 34 that are remote from one another in such a way that the center of gravity of the cabin 22 is located between two vertical transverse planes perpendicular to the reference axis 200 which each pass through one of the two bearings 34. The two bearings 34 are preferably located such that their positions mirror one another with respect to a median transverse vertical plane of the cabin 22 that is perpendicular to the reference axis 200 and contains the center of gravity G of the cabin 22. Each bearing 34 comprises at least one first bearing ring, for example an inner ring 34.1 rigidly connected to a collar 20.1 of the support 20, at least one second bearing ring, for example an outer ring 34.2 rigidly connected to a collar 22.2 of the cabin 22, and one or more rows of bearing bodies 34.3 capable of rolling on bearing races formed on the first bearing ring 34.1 and the second bearing ring 34.2. Each of the two bearings 34 surrounds the inner volume V such that part of each bearing 34 is located under the floor 26, and another above the ceiling 28.

The guide 32 allows the horizontality of the floor of the cabin 26 to be maintained by allowing the rotation of the support 20 about the axis of rotation 100 of the Ferris wheel 10 in a direction S1, with the rotation of the cabin 22 relative to the support 20 about the reference axis 200 in the opposite direction S2.

In order to synchronize these rotations, the movable sub-assembly 30 is equipped with a stabilization system 36. This stabilization system 36 here comprises two toothed rings 38 centered on the reference axis 200, each preferably being positioned close to one of the bearings 34 and two gears 40, each associated with one of the two toothed rings 38, and being mounted on the cabin 22 so as to mesh with the associated toothed ring 38. The cabin 22 is also equipped with drive means 42 which can comprise a motor associated with each gear, or a separate motor for each gear.

In order to maintain the horizontality of the floor 26 of the cabin 22, the drive means 42 can be servo-controlled in the angular position of the wheel rim 12 about the axis of rotation 100 of the Ferris wheel 10, for example by comparing a measurement of the angular position of the cabin about the axis of rotation and a measurement of the angular position of the cabin with respect to the support. For this purpose, one of the bearings 34 can be equipped to deliver a measurement of this angular position. Alternatively, the drive means 42 can be servo-controlled at an inclinometer positioned in the cabin 22. Other physical variables can also be taken into account for controlling the drive means 42, in particular the load of the cabin 22, the position of the center of gravity of the loaded cabin 22, the speed and direction of the wind, or the data derived from the preceding cabin 22 in the direction of travel of the Ferris wheel 10.

Each of the gears 40, or at least one of them, driven by the drive means 42, meshes with the associated toothed ring 38 that is rigidly connected to the support 20 in order to maintain the horizontality of the floor 26 of the cabin 22. The closer the center of gravity of the loaded cabin 22 is to an axial reference plane Q of the cabin 22 that is perpendicular to the floor 26 and contains the reference axis 200, the less energy is required. In practice, the center of gravity of the loaded cabin 22 is located below a horizontal plane H containing the reference axis 200 between the reference axis 200 and the floor 26, or below the floor 26, which allows a downgraded operating mode to be considered in which, in the case of malfunction of the drive means 42, the effect of gravity allows the horizontality of the floor 26 to be more or less maintained. For this purpose, a clutch is provided in the kinematic chain of transmission between the drive means 42 and the gears 40.

In this first embodiment, each toothed ring 38 has a toothing 38.1 facing radially inward, and the associated gear 40 is located above the ceiling 28 of the inner space V of the cabin 22 and engaged with a zone of the toothing 38.1 that is also located above the inner ceiling 28 of the cabin 22, and, remarkably, above the associated gear 40. This positioning prevents a foreign object, which has fallen on the toothing 38.1 in the part of the toothing 38.1 located below the horizontal plane H containing the reference axis 200, from reaching the gear 40 and blocking it.

Figure 5:
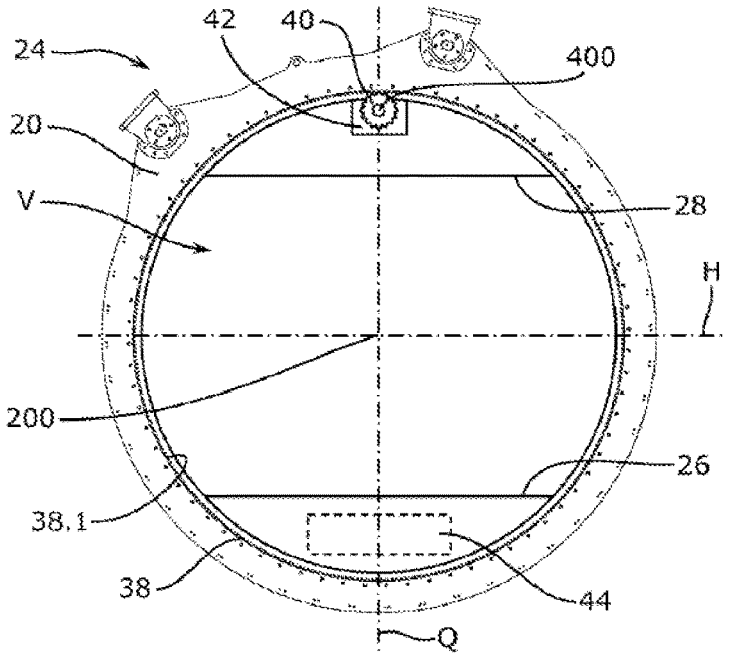
FIG. 5 is a schematic frontal view of the stabilization system according to the first embodiment of the invention.
Figure 6:
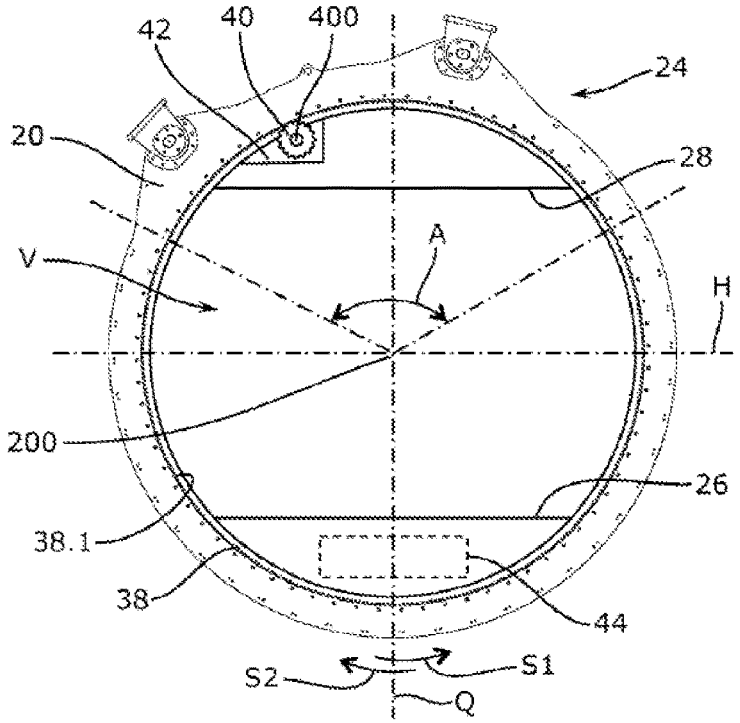
FIG. 6 is a schematic frontal view of the stabilization system according to a second embodiment of the invention.

The axes of rotation 400 of the gears 40 are preferably positioned close to the axial reference plane Q, or directly in the axial reference plane Q, as shown in FIG. 5, or on one side of the axial reference plane Q in an angular sector A less than or equal to ±60° with respect to the axial reference plane around the reference axis, as shown in FIG. 6. In this scenario, each gear 40 is preferably arranged downstream of the axial reference plane Q in the direction of rotation of the toothed ring 38 with respect to the cabin 22, such that at a given moment the toothed zone engaged with the gear 40 has passed through the axial reference plane Q a few moments before.

The space located under the floor is occupied by a cooling, heating, or air conditioning unit 44 of the cabin 22 which contributes to lowering the center of gravity of the cabin 22.

Each gear 40 can be provided with an uncoupling mechanism capable of releasing the gear 40 from the toothing 38.1. Also conceivable is a clutch to allow free rotation of the gear 40 in the case of motor failure. These arrangements ensure redundance which increases the operating ability of the installation: if a motor 42 malfunctions, the associated gear 40 is disengaged and the other motor 42 alone ensures the positioning of the cabin 22; in a scenario in which a foreign object gets between one of the gears 40 and the associated toothing 38.1 despite the positioning of the gear 40 below the toothing 38.1, the uncoupling mechanism allows the affected gear 40 to be released, and the other gear 40 alone ensures the positioning of the cabin 22.

Figure 7:
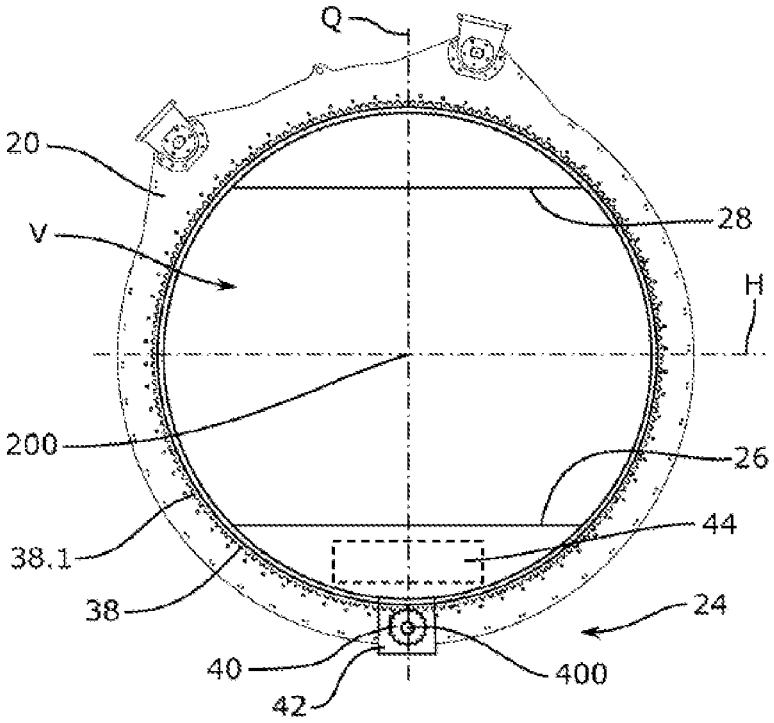
FIG. 7 is a schematic frontal view of the stabilization system according to a third embodiment of the invention.
Figure 8:
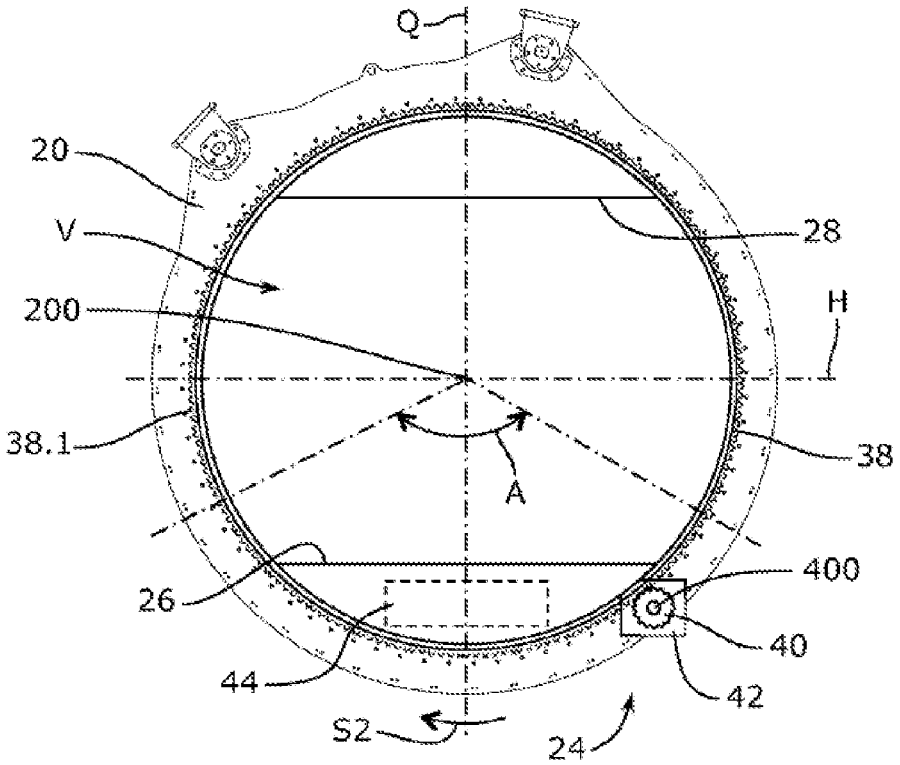
FIG. 8 is a schematic frontal view of the stabilization system according to a fourth embodiment of the invention.

According to other embodiments, the ring 38 with its toothing 38.1 facing radially outward, and the gear 40 located below the toothing 38.1, is positioned below the floor 26 of the cabin 22, as shown in FIGS. 7 and 8. This positioning allows the same effect of ejecting by free fall any foreign object which may have become lodged on the toothing.

Here, too, the axis of rotation 400 of each gear 40 is preferably positioned in the axial reference plane, as shown in FIG. 7, or at a small distance from the axial reference plane in an angular sector less than or equal to ±60° with respect to the axial reference plane around the reference axis, as shown in FIG. 8. In this scenario, the gear is preferably arranged downstream of the axial reference plane Q in the direction of rotation S1 of the toothed ring, such that at a given moment the toothed zone engaged with the gear has passed through the axial reference plane a few moments before.

Figure 9:
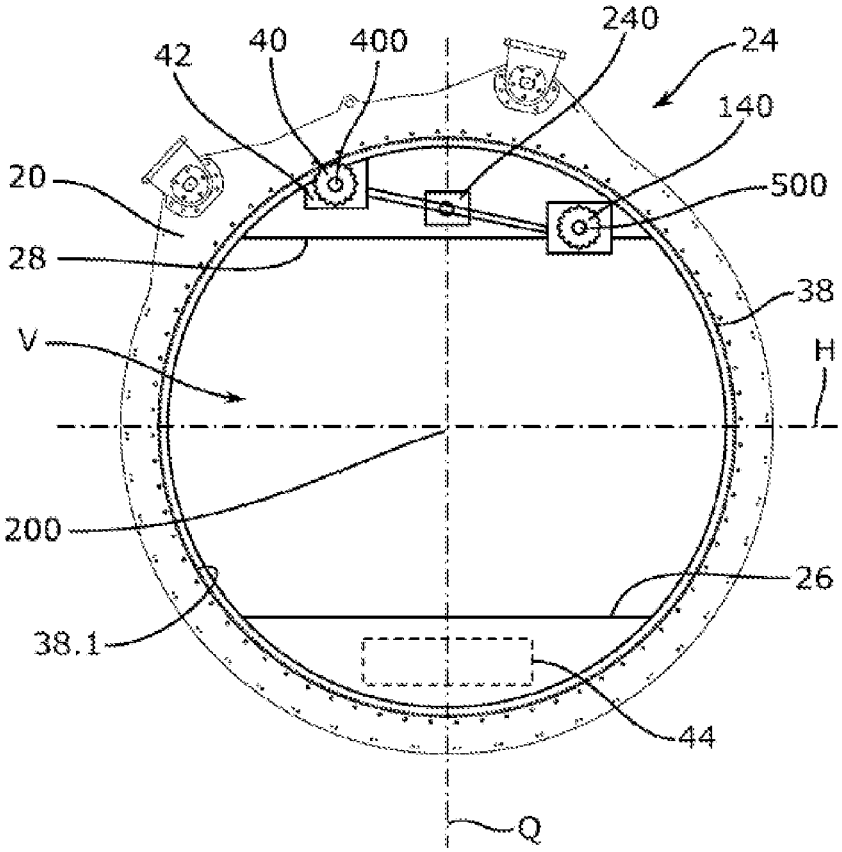
FIG. 9 is a schematic frontal view of the stabilization system according to a fifth embodiment of the invention.

According to an embodiment shown in FIG. 9, there are two gears 40, 140 located on either side of the axial reference plane Q, preferably at equal distance from the axial reference plane Q, and a mechanism 240 which, on the basis of the relative direction of rotation between the toothed ring 38 and the cabin 22, engages one or the other of the two gears 40, 140 that is engaged with the same toothed ring 38. The gear 40, 140 which meshes with the toothed ring 38 is systematically the gear located downstream of the axial reference plane Q in the direction of rotation S1 of the ring with respect to the cabin 22. The axis of rotation 400 of the first gear 40 and the axis of rotation 500 of the second gear 140 are preferably located in an angular sector less than or equal to ±60° with respect to the axial reference plane around the reference axis.

Of course, the examples shown in the drawings and discussed above are given only by way of example and in a non-limiting manner. It is explicitly stated that it is possible to combine different embodiments from among those shown so as to suggest other embodiments.

According to a simplified embodiment, the stabilization system 24 can only comprise one toothed ring 38 associated with a single gear 40. The ring is thus preferably positioned close to a transverse plane containing the center of gravity of the empty cabin 22. If the guide 32 comprises two bearings 34, the single toothed ring 38 is preferably positioned axially between the two bearings 34.

The ring of each bearing that is rigidly connected to the cabin 22 can be the inner ring 34.1 or the outer ring 34.2.

The axis of rotation of the gear 40 is preferably parallel to the reference axis 200, although a different orientation is also conceivable if the meshing achieved between the toothed ring 38 and the gear 40 is at an angle.

The support is not necessarily part of the rim 12 of a Ferris wheel 10. It can also be a movable car on a guide path of a stationary structure of the type described in EP 2 075 043 which forms a closed loop, either circular or non-circular, in a vertical plane. In all the proposed configurations, the movement of the support 20 in a loop results in one rotation of the support 20 with respect to a fixed frame of reference of a lap per completed lap of the loop.

It should be pointed out that all the features as they emerge to a person skilled in the art from the present description and the attached drawings and claims, even if they have not specifically been described in relation to other determined features, either alone or in combination, can be combined with other features or groups of features disclosed here, as long as this has not been expressly excluded or technical circumstances make such combinations impossible or non-sensical.

The invention claimed is:

1. A movable sub-assembly for accommodating and conveying at least one passenger, comprising a support, a cabin, and a guide for rotationally guiding the cabin relative to the support about a reference axis common to the support and to the cabin, the reference axis being horizontal when the movable sub-assembly is in an operational state, the movable sub-assembly being equipped with a stabilization system comprising at least one toothed ring rigidly connected to the support and centered on the reference axis, at least one first gear supported by the cabin so as to mesh with the toothed ring, and drive means capable of driving the first gear, wherein the first gear is supported by the cabin so as to mesh with a zone of the toothed ring that is located above the first gear.

2. The movable sub-assembly according to claim 1, wherein the first gear is guided relative to the cabin so as to rotate about a first drive axis parallel to the reference axis.

3. The movable sub-assembly according to claim 2, wherein the first drive axis is positioned, with respect to an axial reference plane, in an angular sector less than or equal to 60° around the reference axis and on a first side of the axial reference plane, the axial reference plane being vertical and containing the axis of rotation when the movable sub-assembly is in the operational state.

4. The movable sub-assembly according to claim 3, wherein the first drive axis is positioned in the axial reference plane.

5. The movable sub-assembly according to claim 3, wherein the first drive axis is positioned at a distance from the axial reference plane on a first side of the axial reference plane.

6. The movable sub-assembly according to claim 5, wherein the stabilization system comprises at least one second gear which is supported by the cabin so as to mesh with the toothed ring, the second gear being driven by the drive means and being capable of meshing with a second zone of the toothed ring that is located above the second gear, the second gear being guided relative to the cabin so as to rotate about a second drive axis which is parallel to the reference axis and which is positioned, with respect to the axial reference plane, in an angular sector less than or equal to 60° around the reference axis at a distance from the axial reference plane on a second side of the axial reference plane that is opposite the first side.

7. The movable sub-assembly according to claim 5, wherein the stabilization system comprises a coupling device capable of alternately coupling the first gear or the second gear to the toothed ring.

8. The movable sub-assembly according claim 1, wherein the cabin has an inner volume for accommodating at least one passenger, the toothed ring surrounding the inner accommodating volume when viewed in a section in a plane perpendicular to the reference axis.

9. The movable sub-assembly according to claim 1, further comprising a device for cleaning the toothed ring that is positioned in an angular sector of the toothed ring located between the zone of the toothing with which the first gear meshes and a plane which contains the reference axis and is horizontal when the movable sub-assembly is in the operational state.

10. The movable sub-assembly according to claim 1, further comprising a device for detecting obstructions to the meshing that is positioned in an angular sector of the toothed ring located between the zone of the toothing with which the first gear meshes and a plane which contains the reference axis and is horizontal when the movable sub-assembly is in the operational state.

11. The movable sub-assembly according to claim 1, wherein the toothed ring has a toothing (38.1) facing the reference axis.

12. The movable sub-assembly according to claim 11, wherein the first gear is positioned above an inner ceiling of the cabin.

13. The movable sub-assembly according to claim 11, wherein a cooling, heating, or air conditioning unit of the cabin is positioned below an inner floor of the cabin.

14. The movable sub-assembly according to claim 1, wherein the toothed ring has a toothing (38.1) facing radially outward, the first gear being positioned below a floor of the cabin.

15. An attraction installation comprising at least one stationary structure, and at least one movable sub-assembly for accommodating and conveying at least one passenger, the sub-assembly comprising a support, a cabin, and a guide for rotationally guiding the cabin relative to the support about a reference axis common to the support and to the cabin, the reference axis being horizontal when the movable sub-assembly is in an operational state, the movable sub-assembly being equipped with a stabilization system comprising at least one toothed ring rigidly connected to the support and centered on the reference axis, at least one first gear supported by the cabin so as to mesh with the toothed ring, and drive means capable of driving the first gear, wherein the first gear is supported by the cabin so as to mesh with a zone of the toothed ring that is located above the first gear, wherein the sub-assembly is guided relative to the stationary structure in such a way that the support follows a trajectory that forms a loop in a vertical plane of a fixed frame of reference, and which, with respect to a fixed axis of rotation that is perpendicular to the vertical plane and parallel to the reference axis, makes a rotation of 360° by completing a lap of the loop-shaped trajectory.

* * * * *